United States Patent [19]

Nied et al.

[11] Patent Number: 4,762,765

[45] Date of Patent: Aug. 9, 1988

[54] METHOD OF GENERATING A SPHERICAL GRAIN

[75] Inventors: Roland Nied, Bonstetten; Herbert Hackl, Augsburg, both of Fed. Rep. of Germany

[73] Assignee: Alpine Aktiengesellschaft Augsburg, Augsburg, Fed. Rep. of Germany

[21] Appl. No.: 843,447

[22] Filed: Mar. 24, 1986

[30] Foreign Application Priority Data

Mar. 23, 1985 [DE] Fed. Rep. of Germany ..... 3510610

[51] Int. Cl.[4] ..... G03G 9/00

[52] U.S. Cl. ..... 430/137; 241/5

[58] Field of Search ..... 241/1, 5, 39; 51/313; 427/185, 213; 430/137

[56] References Cited

U.S. PATENT DOCUMENTS

| | | | |
|---|---|---|---|
| 3,196,032 | 7/1965 | Seymour | 430/137 |
| 3,311,307 | 3/1967 | Lopker | 241/39 |
| 3,586,654 | 6/1971 | Lerman et al. | 430/137 |
| 3,639,245 | 2/1972 | Nelson | 252/62 |
| 4,251,616 | 2/1981 | Hendriks | 430/107 |
| 4,455,360 | 6/1984 | Ishikawa et al. | 430/109 |
| 4,579,288 | 4/1986 | McDermid et al. | 241/39 |
| 4,602,743 | 7/1986 | Nied | 241/39 |
| 4,645,606 | 2/1987 | Ashbrook et al. | 241/39 |

FOREIGN PATENT DOCUMENTS

| | | |
|---|---|---|
| 3248504 | 7/1983 | Fed. Rep. of Germany . |
| 1586735 | 3/1981 | United Kingdom . |

*Primary Examiner*—John L. Goodrow

*Attorney, Agent, or Firm*—Pennie & Edmonds

[57] ABSTRACT

The invention relates to a process for producing a spherical grain shape in fine grain toners. The toners are of the type used in electrophotography for developing latent charge images. The treatment of the toner takes place in a material bed which is fluidized by gas streams which are directed against one another. In this manner the grains are subjected to a multitude of reciprocal collisions and friction stress. The intensity of the collisions and frictional stress are adjusted through selection of the operating pressure, velocity, direction and temperature of the gas streams. Thus the grains undergo permanent deformation. A classifier to separate out the super-fine portion resulting from abrasion.

4 Claims, 1 Drawing Sheet

METHOD OF GENERATING A SPHERICAL GRAIN

FIELD OF THE INVENTION

The invention relates to a method of generating a spherical grain and in particular to spherical grains of toner for use with electrophotography.

BACKGROUND

The term "toners" as used herein designates the fine-grain, electrically chargeable powders used in electrophotography. Such toners are used for developing latent charge images, for example in photocopy machines. The toners comprise a mixture of natural and/or synthetic resins with a low melting point and resin-soluble or resin dispersible coloring materials. Also included are additives affecting the physical properties of the toner such as their direction of charge, their adhesion to recording material and their tendency toward agglomeration. Preferably the toner is a readily flowing powder that causes only small amounts of mechanical abrasion of the electrophotographic recording elements and is resistant to deterioration of its physical properties. The toner must further be able to transfer rapidly and completely from the recording material to an image-receiving material. The various desired toner properties are best obtained by a toner that has a spherical grain shape.

There are several known processes for producing toners. German patent disclosures Nos. 28 15 093 and 30 22 333 provide examples of processes for imparting spherical shape to toner particles which have already been reduced to the desired grain size. In one case the resin is melted and mixed with the other ingredients. The molten mass thus produced is sprayed to make the spherical grains. This procedure however is only useful with substances which become highly fluid on melting. A second known method is to dissolve the toner material in a solvent with a low boiling point and then spray the solution at a pressure of 10 to 15 bars. Heat is used to subsequently remove the solvent. In each case toner particles with a nearly ideal spherical shape are obtained. However, these processes are costly in terms of energy and difficult to operate.

In most cases however the toner material is mixed, cooled and then coarsely broken up. This material is further reduced to the desired grain size in a pulverizer such as a ball mill. The toner particles are thereafter subject to a heat treatment that bring the resin serving as a binder to its melting point. The surface tension of the melted particle causes the particle to take on a spherical shape. To achieve this result the toner particles are mixed with air to form an aerosol. The aerosol is directed in a cross-current or counter-current with a hot air stream as in German published patent application No. 19 37 651. Alternatively, the spherical shape may be obtained by using hot air to form a fluidized bed of toner particles, as in german patent disclosure No. 27 29 070.

A particular disadvantage of these hot air methods is that the air must be at a temperature of approximately 500° C. At this temperature the toner particles readily stick together and form inseparable agglomerates. Further, melt incrustations build up on the walls of the apparatus and tubing and unwanted chemical transformations take place in the toner components.

It is an object of the present invention to provide a process for producing a spherical grain shape in fine-grain toners wherein the toners are in solid form (i.e. beneath the toner melting temperature) and without the use of solvents. This provides for a lower expenditure of energy than in known processes. The particles are to be treated in a fluidized material bed and the grain-size band of the toner particles is to be superfine grain size.

SUMMARY OF THE INVENTION

The process of the invention treats toner particles to produce spherical grain shape by creating a fluidized bed of material. Gaseous streams are directed against one another to create the fluidized bed. In this way the individual toner particles are subjected to mutual collision and friction. The intensity of the collisions and friction action may be changed by adjusting the operating pressure, velocity, direction and temperature of the gas streams. The toner particles are permanently deformed by this action. Subsequently the toner particles are subjected to centrifugal classification to separate out the extremely fine toner particles which result from the abrasion and collision.

Even at temperatures below the melting point of their components, toner particles undergo permanent plastic deformation if they are caused to bounce off one another with a given kinetic energy. As a result of the energy released on collision, the toner particles are briefly plasticized at the point of impact without size reduction or sticking together. To a certain degree a forging-type process is involved in which each instance of two toner particles colliding with one another is as if each particle acts as the hammer for the other particle. When the bed of material is fluidized by means of two gas streams directed against one another these collisions occur frequently to each particle. The location of the collisions is distributed statistically about the surface of each particle. Because of this distribution of the collisions, the particle obtains a spherical grain shape. Actually each particle takes on the shape of a polyhedron which closely approximates a sphere.

Any dust that might be formed in this process and the superfine portions of toner created in the previous size reduction process (under 5 micrometer, for example) are removed by a subsequent centrifugal classification of the reformed toner particles.

The process may be carried out at room temperature. However, it has proved advantageous for the toner particles to be heated to a temperature that is somewhat lower than the melting temperature of the components of the toner. In this event, optimal results are achieved when the effective temperature of the toner particles remains at least five degrees kelvin below the melting temperature. This measure makes it possible to reduce the energy introduced by the gas stream so that particularly gentle treatment of the toner particles can take place.

A further advantage to the process of the invention has been found in applying surface-active substances. Previously such substances were embedded in the toner mass when the spherical grains were heated to begin to cause them to melt. This method however was not available for thermally sensitive substances. Alternatively the substances were applied to the surface of the toner particle in a mixing operation and maintained on the particle surface by means of adhesive forces. During subsequent use however, the substances are easily rubbed off by mechanical actions and thereby impair the toner use. However, by use of the present invention, such surface-active substances may be more easily applied. The substances may be applied simultaneously with the reformation of the particle. The substances become forced into the toner particle when the particles become plastic from impact and friction. The substances then remain in the particles after they solidify.

BRIEF DESCRIPTION OF THE DRAWING

The FIGURE shows an apparatus suitable for carrying out the process of the invention.

DESCRIPTION OF THE PREFERRED EMBODIMENT

Figure 1:
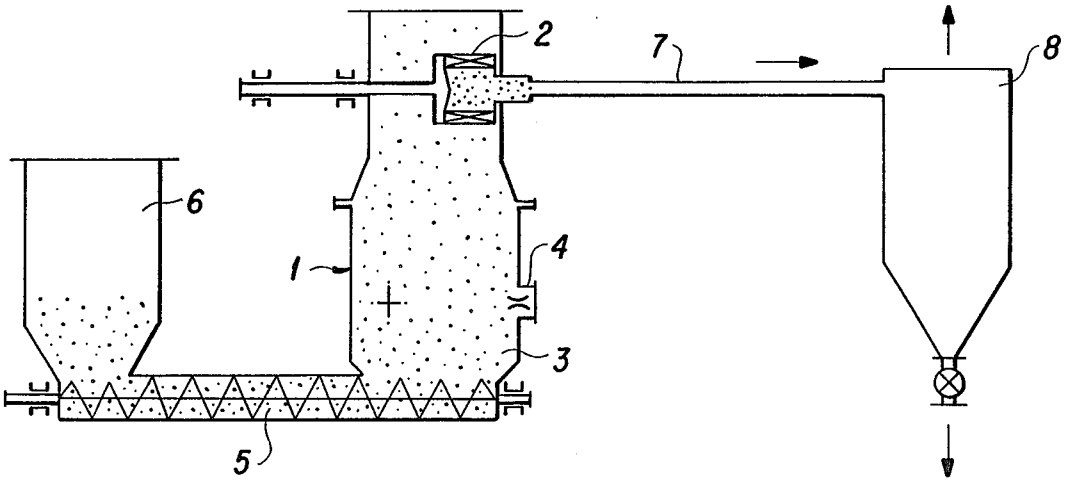

The process of the invention is generally carried out in a fluidized-bed countercurrent mill as is described in the journal "Aufbereitungs-Technik," No. 5 pp. 236–242 (1982). Such mills consist of a cylindrical grinding chamber with a vertical axis. Nozzles, for blowing in gas streams, are evenly spaced about the periphery. The nozzles are positioned such that the gas streams are directed against one another. In the upper portion of the grinding chamber there is a centrifugal separator in the form of a rotating basket classifier. The classifier permits the air and particles entrained therein to pass through the basket against the centrifugal direction. Oversized particles are rejected by the rotating basket.

The only driving means within the chamber is the gas brought in through the nozzles. This gas serves to cause the collision and friction among the particles and further serves as the carrying gas for carrying the entrained particles through the classifier. The intensity of the gas streams can be varied easily over a broad range by varying the number and size of the nozzles. The direction of the axis of the nozzle, operating pressure of the gas and temperature of the gas may also be adjusted. This allows for variation for optimum setting for particular products. The size demarcation at which superfine particles are separated out is determined by the speed of rotation of the basket classifier. The higher the rotational speed, the smaller the grain size demarcation.

With such a fluidized bed countercurrent mill the creation of the spherical grain shape, application of surface-active agents and separation of the finest portion can be carried out in a single operation. This permits very simple process control.

Shown in the FIGURE is an apparatus suitable for use in the process of the present invention. The grinding chamber 1 has a vertical axis. At the top of the chamber there is a classifier 2 which is positioned to separate out the treated particles. The particles are treated in a fluidized bed 3 by nozzles 4. The nozzles are positioned to cause a counter current, that is a component of their velocity is opposite to one another. The material is fed to the bed via screw 5 which conveys the material from storage hopper 6. Once treated, the particles rise in a gas stream to classifier 2 which separates the particles so the desired size is removed through pipe 7. The particles are separated from the gas stream which carries them in discharger 8.

I claim:

1. A process for producing a spherical grain shape in fine-grain toners comprising:

(a) directing at least two gaseous streams into a bed of sized toner grains in order to fluidize the bed, said gaseous streams directed in opposite directions toward one another to subject the toner grains to a multitude of mutual collisions to permanently deform the toner grains into a substantially spherical shape and further producing a superfine portion, said gases being of a temperature which heats the toner grains to a temperature below the melting points of said toner grains; and (b) subsequently separating the shaped grains from the superfine portion of toner resulting from said collisions and friction.

2. The process according to claim 1 wherein:

(a) the toner grains are heated to a temperature at least five degrees kelvin lower than said melting temperature.

3. The process according to claims 1 or 2 further comprising:

(a) applying a surface-active substance to the grains before they complete said multitude of collisions.

4. The process according to claims 1 or 2 wherein:

(a) a fluidized bed countercurrent mill is used to direct said gaseous streams; and (b) a centrifugal classifier is used to separate the grains and super-fine portion of toner.

* * * * *